US006467104B1

(12) United States Patent
Shieh

(10) Patent No.: US 6,467,104 B1
(45) Date of Patent: Oct. 22, 2002

(54) FAUCET ASSEMBLY HAVING AN ATTACHABLE SPRAYER NOZZLE

(76) Inventor: Ming Chun Shieh, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/902,734

(22) Filed: Jul. 12, 2001

(51) Int. Cl.[7] ..... E03C 1/04
(52) U.S. Cl. ..... 4/676; 137/119.04
(58) Field of Search ..... 137/119.04, 625.18, 137/801; 4/676, 678

(56) References Cited

U.S. PATENT DOCUMENTS 2,314,071 A * 3/1943 Bucknell et al. ..... 137/119.04
2,348,238 A * 5/1944 Beeke et al. ..... 4/676 X
3,880,183 A * 4/1975 Humpert et al. ..... 4/678 X
4,798,221 A 1/1989 Crawford et al. ..... 137/119.04
RE32,981 E 7/1989 Marty ..... 137/119.04
6,062,249 A * 5/2000 Givler ..... 137/119.04
6,079,061 A * 6/2000 Fan ..... 4/676
6,161,581 A 12/2000 Yang ..... 137/625.19

* cited by examiner

*Primary Examiner*—Robert M. Fetsuga

(57) ABSTRACT

A faucet device includes a faucet member having one or more ports for coupling to water reservoirs and a water outlet. The faucet member includes a hole and a chamber communicating with each other. A hose has one end coupler for selectively securing to the hole of the faucet member, and a sprayer device coupled to the other end. A valve device may be used for controlling the water to flow out through the sprayer device and the outlet of the faucet member. A lock cap may be selectively secured to the hole of the faucet member when the coupler is disengaged from the faucet member.

1 Claim, 6 Drawing Sheets

FAUCET ASSEMBLY HAVING AN ATTACHABLE SPRAYER NOZZLE

BACKGROUND OF THE INVENTION

1. Field of the Invention

The present invention relates to a faucet, and more particularly to a faucet assembly having a selectively attachable sprayer nozzle or the like.

2. Description of the Prior Art

As shown in FIGS. 1 and 2, the typical faucets comprise a faucet body 70 including two ports 71, 72 attached to a supporting surface 80 of a wall member (FIG. 1), or to a supporting surface 81 of a basin 82 (FIG. 2) or the like, for coupling to the cold water and hot water reservoirs respectively and for receiving the cold water and hot water therefrom respectively. The faucet body 70 includes an outlet 73 for supplying the cold water and/or hot water or the mixing thereof outward of the faucet body 70. However, the typical faucets may not be easily attached with a sprayer nozzle or the like. In order to attach or to assemble an additional sprayer nozzle to the faucet, a number of parts are required to be disassembled from the faucet or from the supporting surface, and a three-way valve and the other parts or elements are also required to be assembled to the faucet. The additional sprayer nozzles thus may not be attached to the faucets by the users, and may have to be attached to the faucets by the experts or by the specialized persons.

U.S. Pat. No. 6,161,581 to Yang, U.S. Pat. No. 4,798,221 to Crawford et al., and U.S. Pat. No. Re. 32,981 to Marty disclose three types of the valve devices or assemblies for controlling the water to flow through different outlets. However, the valves also may not be easily attached or assembled with a sprayer nozzle or a sprayer gun or the like thereto easily; i.e., the other sprayer devices may not be selectively attached or mounted or coupled to the valve devices by the users and should be attached or mounted or coupled to the valve devices by experts or by specialized persons.

The present invention has arisen to mitigate and/or obviate the afore-described disadvantages of the conventional faucets.

SUMMARY OF THE INVENTION

The primary objective of the present invention is to provide a faucet assembly including a selectively attachable sprayer nozzle or the like for allowing the users to supply water in a suitable distance away from the faucet assembly, in addition to the typical water outlets of the faucet assembly.

In accordance with one aspect of the invention, there is provided a faucet assembly comprising a faucet body including at least one port for coupling to a water reservoir and including an outlet for allowing the water to flow outward of the faucet body, the faucet body including a hole formed therein, and including a chamber formed therein and communicating with the hole thereof, a hose including a first end having a coupler for selectively securing to the hole of the faucet body, and including a second end having a sprayer device provided thereon, valve means for controlling the water to flow out through the sprayer device and the outlet of the faucet body, and a lock cap selectively secured to the hole of the faucet body when the coupler of the hose is disengaged from the faucet body.

The valve means includes a valve member received in the chamber of the faucet body.

A tube is further provided and includes a first end coupled to the hole of the faucet body, and includes a second end coupled to the coupler of the hose.

A supporting device is further provided for supporting the sprayer device and includes a tubular support having a bore formed therein for slidably receiving the hose.

The faucet body includes an extension extended therefrom, the faucet assembly further includes a shelf secured on the extension of the faucet body. Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
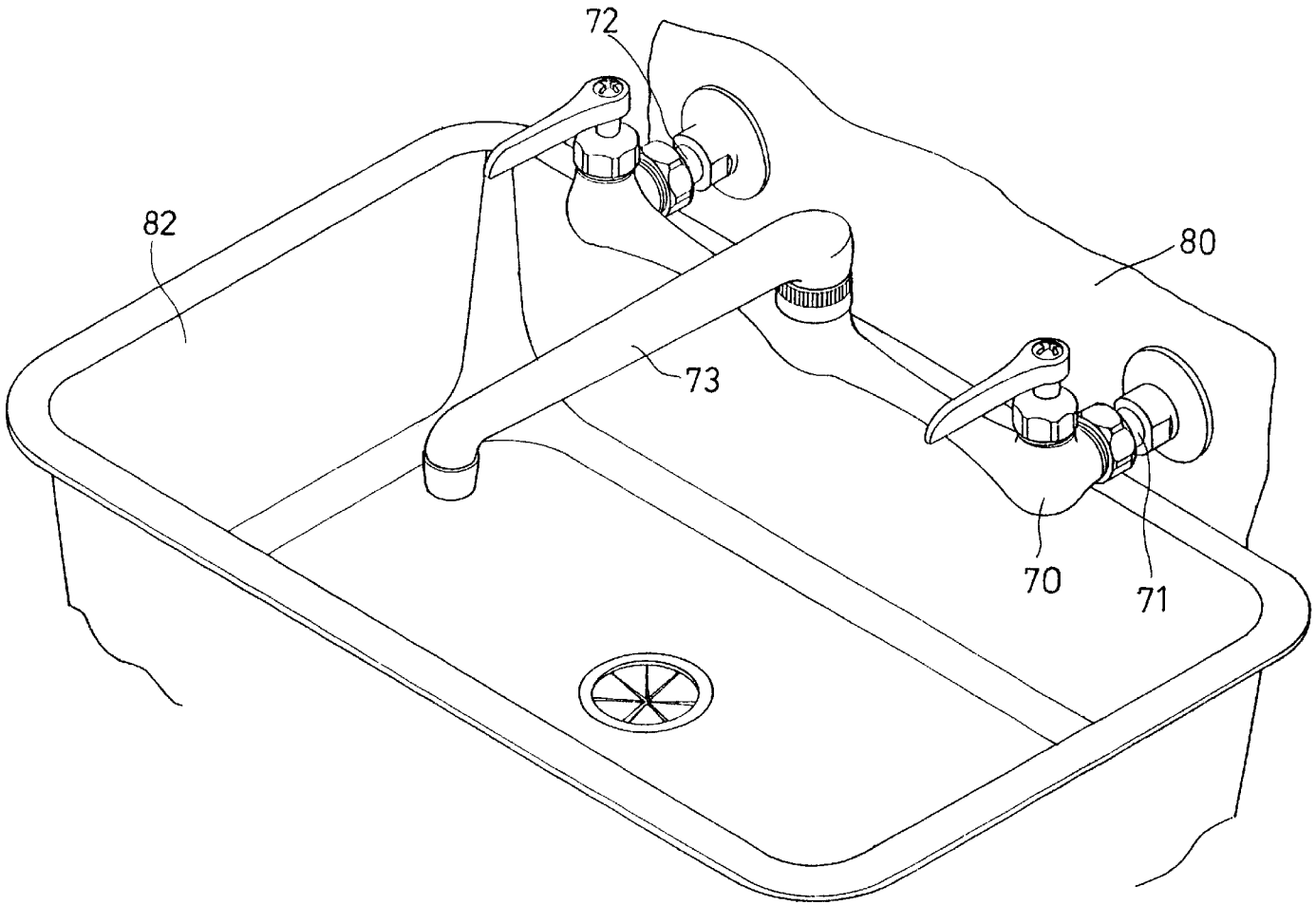
FIG. 1 PRIOR ART
FIGS. 1 and 2 are perspective views showing two of the typical faucets.
Figure 2:
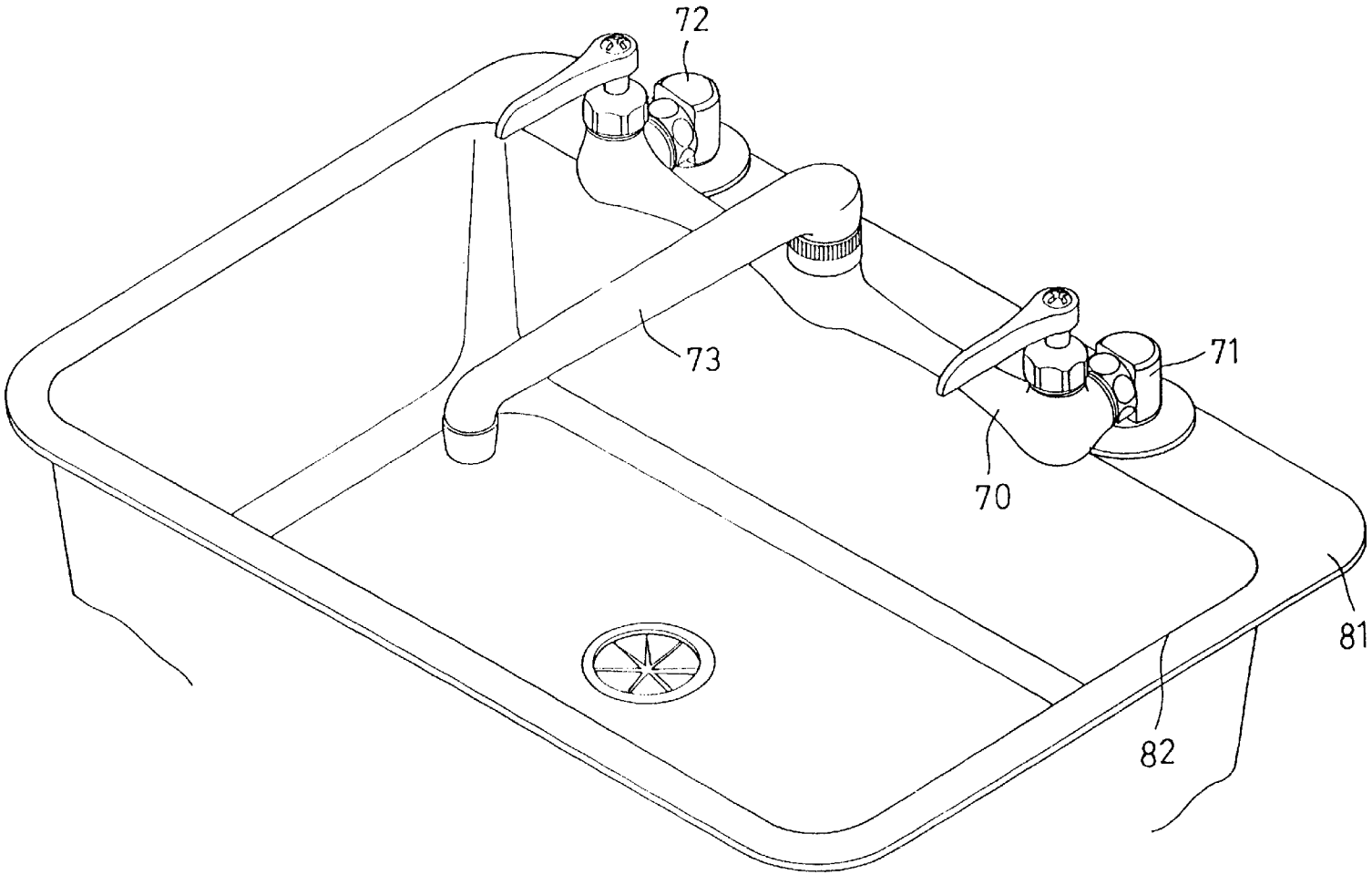
FIG. 2 PRIOR ART
Figure 3:
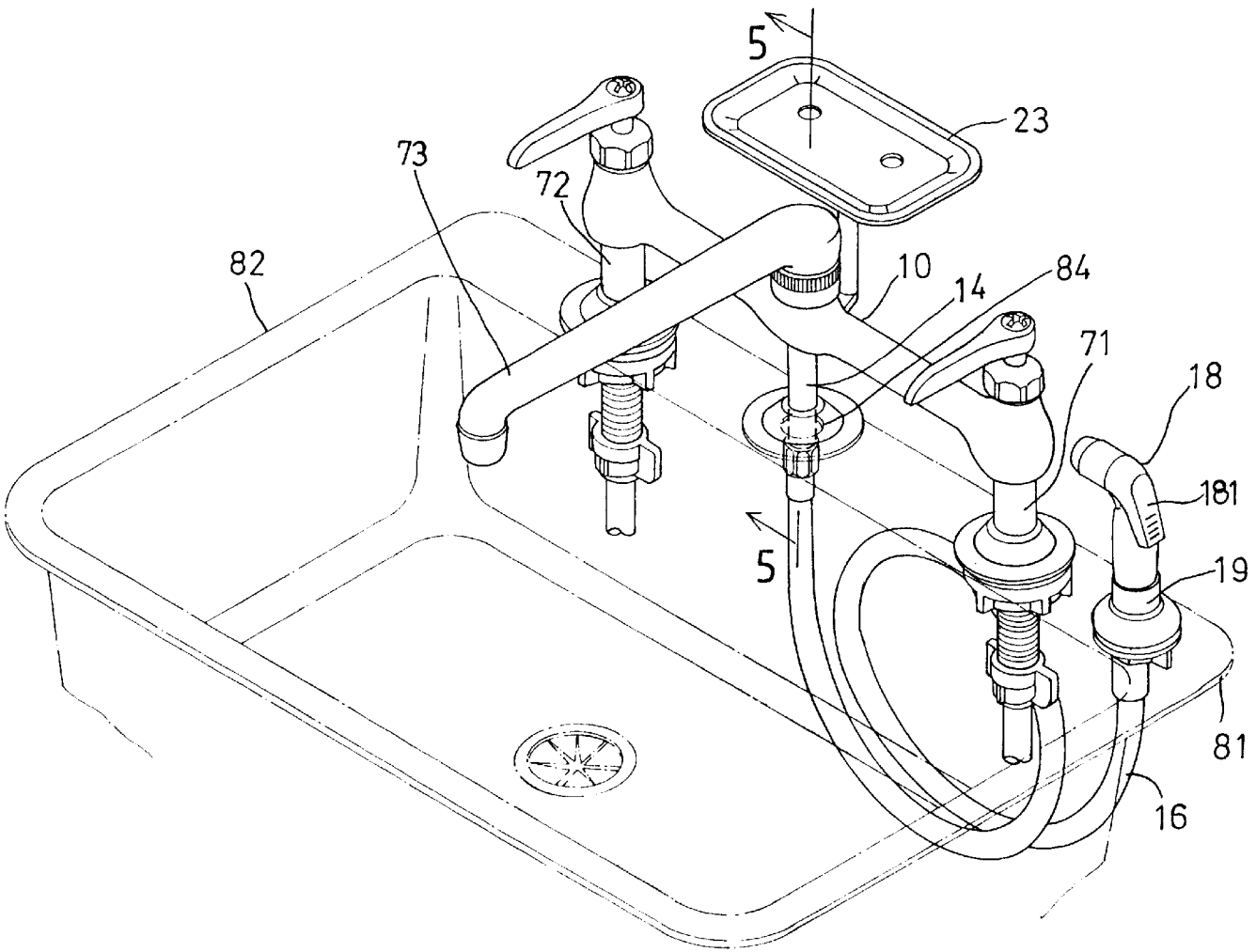
FIG. 3 is a perspective view of a faucet assembly
Figure 4:
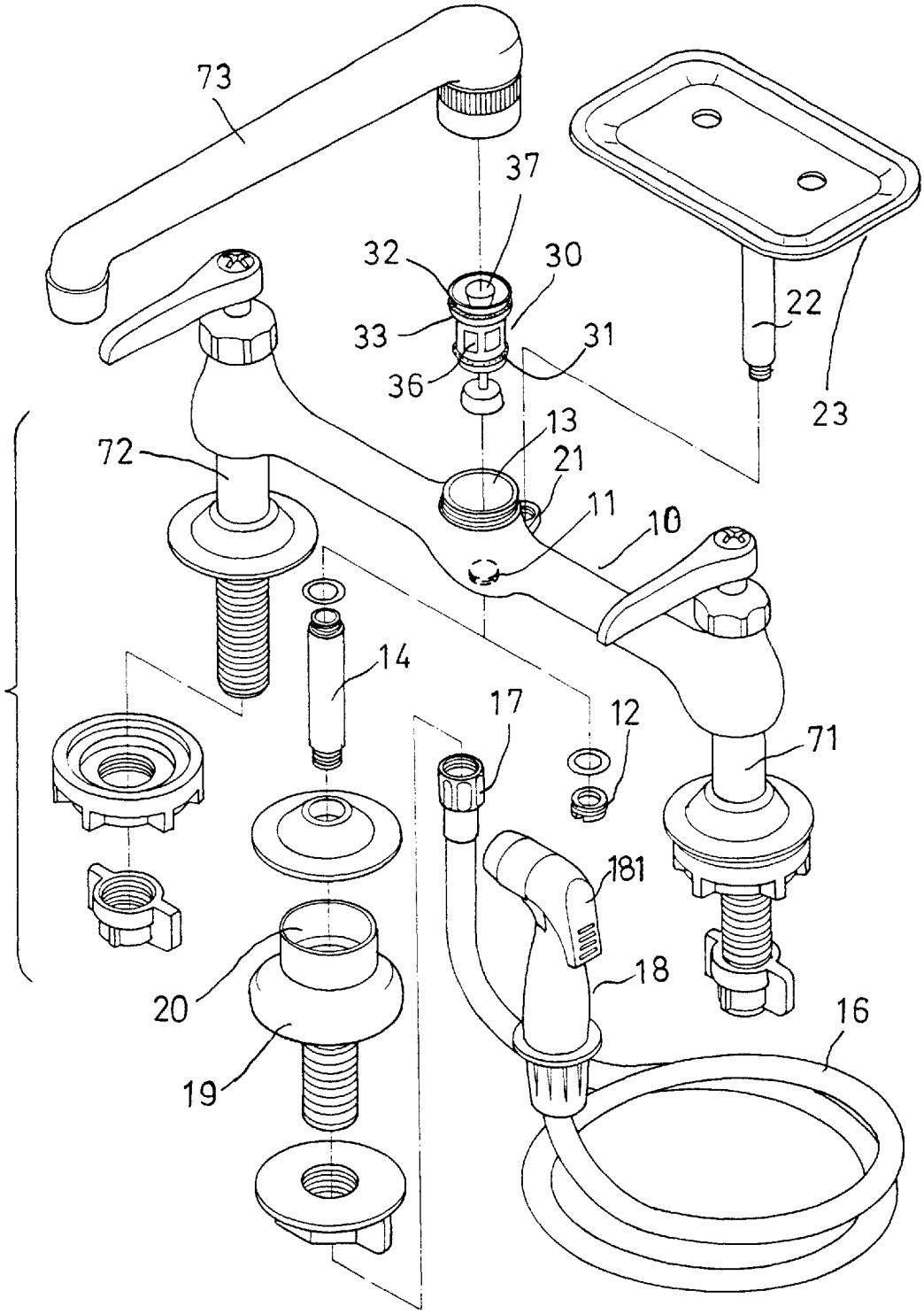
FIG. 4 is a partial exploded view of the faucet assembly in accordance with the present invention.
Figure 5:
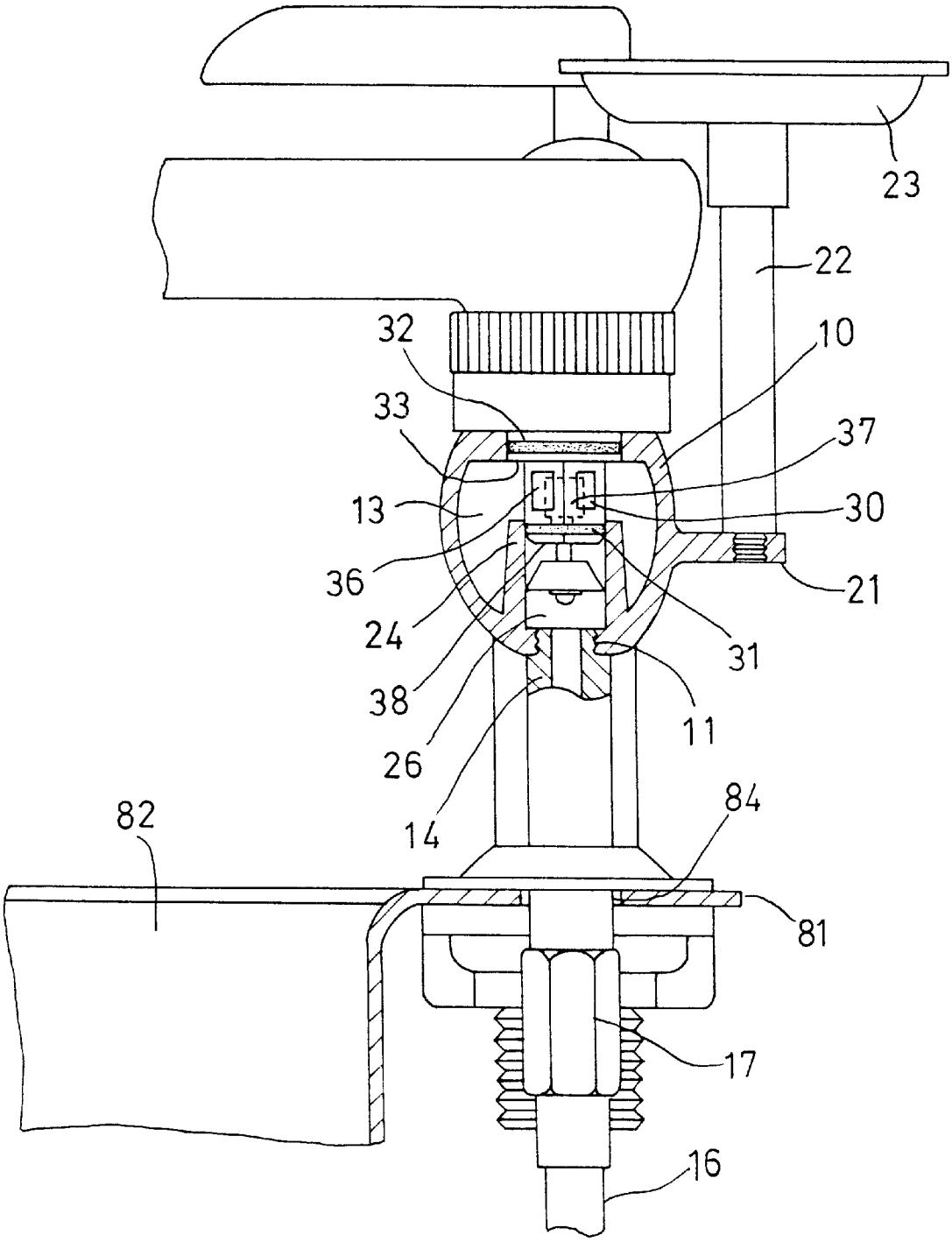
FIG. 5 is a partial cross sectional view taken along lines 5—5 of FIG. 3.
Figure 6:
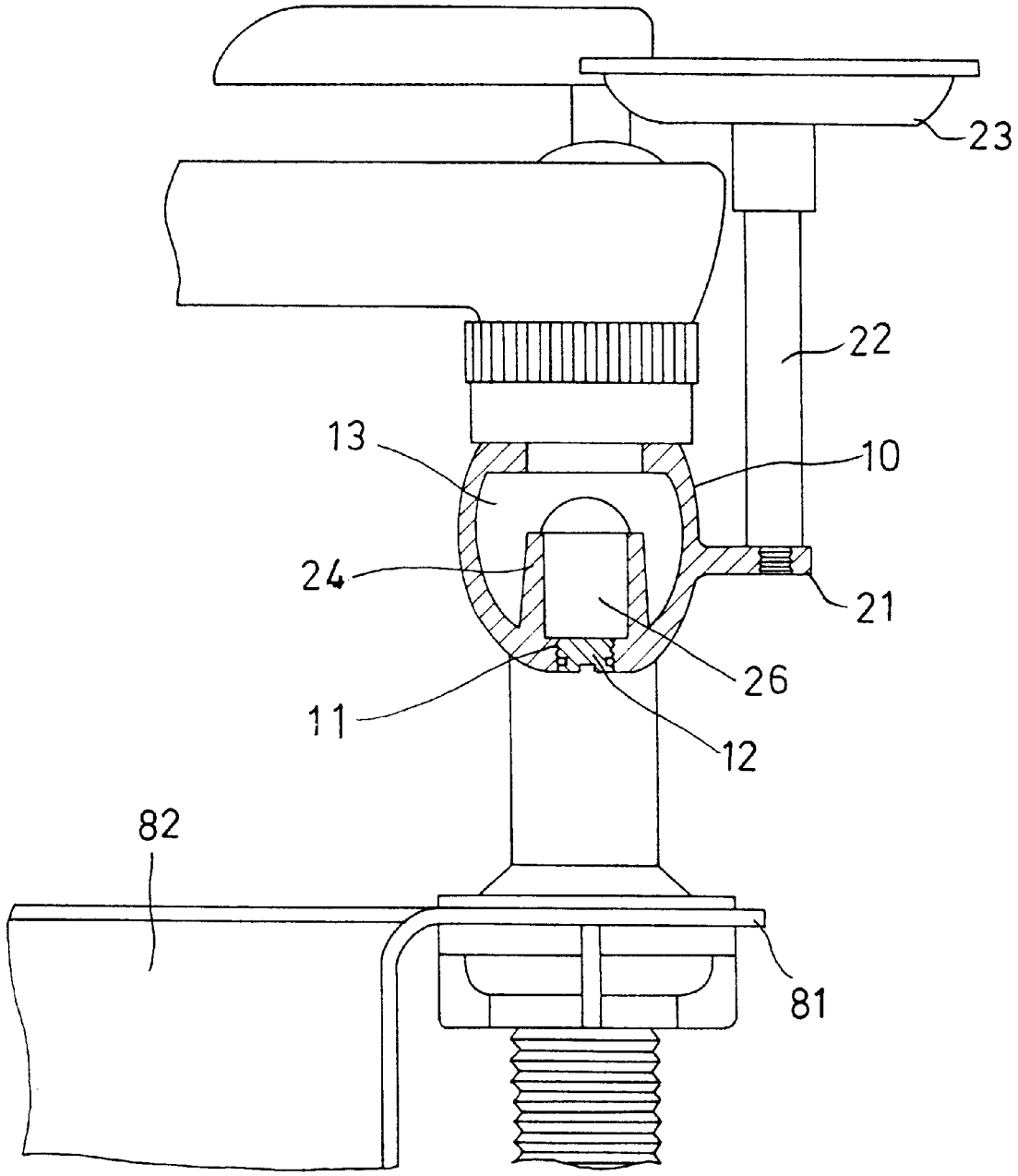
FIG. 6 is a partial cross sectional view similar to FIG. 5, illustrating the operation of the faucet assembly.

Referring to the drawings, and initially to FIGS. 3–5, a faucet assembly in accordance with the present invention comprises a faucet body 10 including two ports 71, 72 attached to a supporting surface of a wall member, or attached to a supporting surface 81 of a basin 82 (FIGS. 3, 5, 6) or the like, for coupling to the cold water and hot water reservoirs respectively and for receiving the cold water and hot water therefrom respectively. The faucet body 10 includes an outlet 73 for supplying the cold water and/or hot water or the mixing thereof outward of the faucet body 10.

The faucet body 10 further includes a hole 11. such as a screw hole 11 formed in the middle and bottom portion thereof, and includes a chamber 13 formed therein and communicating with the hole 11 for receiving a valve member 30 in the chamber 13 thereof. A lock cap 12 (FIGS. 4, 6) may be secured to or threaded with the screw hole 11 of the faucet body 10 (FIG. 6) for enclosing the chamber 13 of the faucet body 10. The faucet body 10 further includes a conduit 24 extended inward of the chamber 13 of the faucet body 10 (FIGS. 5, 6) and having a space 26 formed therein and communicating with the hole 11 of the faucet body 10. The faucet body 10 further includes an extension 21 extended rearward therefrom. A pole 22 may be secured, such as threaded to the extension 21 for supporting a shelf 23 or the like that may be used for supporting the soaps thereon.

A tube 14 has one end or the upper end thereof threaded to the screw hole 11 of the faucet body 10 (FIGS. 3, 5) when the lock cap 12 is disengaged from the screw hole 11 of the faucet body 10, and has the other end or the lower end thereof extended downward through an aperture 84 of the supporting surface 81 of the basin 82 or the like. A longitudinal and/or flexible hose 16 has one end coupled to the lower end of the tube 14 with a coupler 17, and has a sprayer gun or a sprayer nozzle 18 or the like coupled to the other end thereof for spraying purposes. The sprayer nozzle 18 includes a handle 181 for controlling the water out through the sprayer nozzle 18. A tubular support 19 is threaded or secured to the supporting surface 81 of the basin 82 or the like and has a bore 20 formed therein for threading with the hose 16. The hose 16 may be slided or pulled relative to the tubular support 19, such that the sprayer nozzle 18 may be pulled to the other places for supplying the water in a suitable distance away from the faucet body 10 via the hose 16.

The valve member 30 is provided for controlling the water flowing through the sprayer nozzle 18, and includes a sealing ring 31 engaged on the lower portion thereof for engaging with the conduit 24 and for making a water tight seal with the conduit 24, and includes another sealing ring 32 engaged on the upper portion 33 thereof for engaging with the faucet body 10 and for making a water tight seal with the faucet body 10. The valve member 30 includes a middle portion having one or more openings 36 formed therein and communicating with the chamber 13 thereof for allowing the water to flow through the ports 71, 72 respectively, The valve member 30 includes a valve element 37 slidably received in the middle portion thereof, for engaging with a lower portion 38 (FIG. 5) of the valve member 30 and for blocking the water passage through the conduit 24 and the hose 16.

The valve member 30 may be any kind of suitable control valves. For example, U.S. Pat. No. 6,161,581 to Yang, and U.S. Pat. No. 4,798,221 to Crawford et al., and U.S. Pat. No. Re. 32,981 to Marty disclose three of the typical control valves that may be used as the valve member 30, such that U.S. Pat. No. 6,161,581 to Yang, U.S. Pat. No. 4,798,221 to Crawford et al., and U.S. Pat. No. Re. 32,981 to Marty may be taken as the references for the valve member 30 of the present invention.

In operation, when the handle 181 of the sprayer nozzle 18 has not been actuated or has not been operated, the pressure in the hose 16 and in the conduit 24 has not been released, such that the water may not flow out through the hose 16. When the handle 181 of the sprayer nozzle 18 is actuated or operated, the pressure in the hose 16 and in the conduit 24 may be released, and the valve member 30 may then be used to control the water to flow out through the hose 16.

It is to be noted that the tube 14 and the sprayer nozzle 18 may be selectively and easily coupled to the hole 11 of the faucet body 10 when the lock cap 12 is disengaged from the faucet body 10, such that the sprayer nozzle 18 may be easily and quickly coupled to the faucet body 10 by the users, without the specialized persons.

Accordingly, the faucet assembly in accordance with the present invention includes a selectively attachable sprayer nozzle or the like for allowing the users to supply water in a suitable distance away from the faucet assembly, in addition to the typical water outlets of the faucet assembly.

Although this invention has been described with a certain degree of particularity, it is to be understood that the present. disclosure has been made by way of example only and that numerous changes in the detailed construction and the combination and arrangement of parts may be resorted to without departing from the spirit and scope of the invention as hereinafter claimed.

I claim:

1. A faucet assembly comprising:

a faucet body including at least one port for coupling to a water reservoir and including an outlet for allowing the water to flow outward of said faucet body, said faucet body including a hole formed therein, and including a chamber formed therein and communicating with said hole thereof, and including a conduit extended in said chamber of said faucet body, a hose including a first end having a coupler for selectively securing to said hole of said faucet body, and including a second end having a sprayer nozzle provided thereon, a valve member received in said chamber of said faucet body, for controlling the water to flow out through said sprayer nozzle and said outlet of said faucet body, said valve member including a lower portion having a sealing ring engaged thereon and engaged with said conduit for making a water tight seal with said conduit, and including an upper portion having a sealing ring engaged thereon and engaged with said faucet body for making a water tight seal with said faucet body, and including a middle portion having at least one opening formed therein and communicating with said chamber of said faucet body, a valve element slidably received in said middle portion of said valve member, and engageable with said valve member for selectively blocking a water passage through said conduit, a lock cap selectively secured to said hole of said faucet body when said coupler of said hose is disengaged from said faucet body, and a tubular support having a bore formed therein for slidably receiving said hose.

* * * * *